US007951766B1

(12) United States Patent
Frenkel et al.

(10) Patent No.: US 7,951,766 B1
(45) Date of Patent: May 31, 2011

(54) BIO-BASED SOLVENTS AND METHODS FOR USING SAME

(75) Inventors: Peter Frenkel, Danbury, CT (US); Michael G. Denoux, Metairie, LA (US); Garrett M. Mineo, Marrero, LA (US)

(73) Assignee: Galata Chemicals, LLC, Southbury, CT (US)

( * ) Notice: Subject to any disclaimer, the term of this patent is extended or adjusted under 35 U.S.C. 154(b) by 0 days.

(21) Appl. No.: 12/704,721

(22) Filed: Feb. 12, 2010

(51) Int. Cl.
*C11D 7/50* (2006.01)

(52) U.S. Cl. ..... 510/365; 510/405; 510/407; 510/411; 510/505; 510/506

(58) Field of Classification Search ..... 510/365, 510/405, 407, 411, 505, 506
See application file for complete search history.

(56) References Cited

U.S. PATENT DOCUMENTS 6,057,375 A * 5/2000 Wollenweber et al. ..... 516/133
6,506,259 B1 1/2003 Romack et al.
6,649,579 B2 11/2003 Denton
6,797,753 B2 * 9/2004 Benecke et al. ..... 524/114
7,544,763 B2 * 6/2009 Kazemizadeh ..... 528/295.5

FOREIGN PATENT DOCUMENTS

WO 2008/150892 A2 11/2008

OTHER PUBLICATIONS

Information Bulletin for BioRenewables Industrial Degreaser, Spartan News, Spartan Chemical Company, Inc., 1999.
Biorenewables—BioBased cleaning Products Made From Renewable Resources, Spartan Chemical Company, Inc., Jan. 2008.
Spartan CompuClean Custodial Maintenance Management Software by Spartan Chemical company, Inc., 2005.
Spartan Chemical Company home page on LinkedIn, Jan. 2010.
Spartan Chemical Company home page on Twitter, Jan. 2010.
Spartan Chemical Company home page on Facebook, Jan. 7, 2010.

* cited by examiner

*Primary Examiner* — Gregory E Webb
(74) *Attorney, Agent, or Firm* — Dilworth IP, LLC

(57) ABSTRACT

A composition containing an epoxide of fatty acid esters, such as epoxidized methyl soyate prepared by alcoholysis of epoxidized triglycerides, suitable for degreasing, paint removal, cleaning and the like is provided herein. The component can be blended with both conventional and soy-based co-solvents and other components such as surfactants and the like.

21 Claims, No Drawings

BIO-BASED SOLVENTS AND METHODS FOR USING SAME

FIELD OF THE INVENTION

The present invention relates to improved compositions and cleaners containing an epoxide of one or more fatty acid esters.

BACKGROUND OF THE INVENTION

Demand for plant oil-derived solvents continues to grow due to environmental and regulatory pressures to reduce emissions of Ozone Depleting Substances (ODS), Volatile Organic Compounds (VOC) and hazardous Air Pollutants (HAP). These demands are prevalent in all primary use markets including the manufacture of paints, coatings, printing inks, adhesives, cleaning products, as well as the construction and transportation industries, among others.

A number of conventional and environmentally undesirable solvents are potential candidates for replacement with a bio-based solvent. Such conventional solvents include trichloroethylene and mineral spirits in parts cleaning and degreasing applications, hydrocarbons and chlorinated hydrocarbons in general purpose industrial and institutional cleaning formulations, hydrocarbons and methylethyl ketone in solvent carriers for removing/stripping of coatings, inks, adhesives, resins, and graffiti, methylene chloride in paint strippers, carrier solvent for paints, wood and concrete stains and corrosion protection, hand cleaners and other personal care products.

Methyl soyate (bio-diesel) is a commonly used solvent produced from renewable feedstock that finds application as a component in cleaning products. Soybean oil, soybean oil carbonate, soybean oil maleate and hydrogenated soybean oil are other soybean oil-derived solvent components for degreasing, stripping and cleaning formulations. The following references were found to be relevant to plant oil-derived solvents.

U.S. Pat. No. 5,104,567 is directed to cleaning compositions consisting of vegetable oil, such as soybean oil, suitable for removing ink from printing machines and rubber sheets.

U.S. Pat. No. 5,472,631 covers cleaning compositions consisting of vegetable oil, such as soybean oil, and emulsifying surfactants that are suitable for cleaning uncured oil-based paint and varnish from paint brushes and other painting tools.

U.S. Pat. Nos. 6,183,766 and 6,423,329 are directed to skin sanitizing and moisturizing compositions, where the moisturizing agent is selected from the group consisting of castor oil, soybean oil, maleated soybean oil, sunflower oil, cottonseed oil, corn oil, walnut oil, peanut oil, olive oil, cod liver oil, almond oil, avocado oil, palm oil and sesame oil, among others.

U.S. Pat. No. 6,376,455 covers cleaning compositions containing hydrogenated soybean oil.

U.S. Pat. No. 6,395,103 covers degreasing compositions containing 5-75% of an alkyl soyate, such as methyl soyate, and optionally soy carbonate.

U.S. Pat. No. 6,784,147 covers drain cleaning compositions consisting of soy methyl ester or methyl soyate added at 92% and an emulsifier.

U.S. Pat. No. 6,833,345 covers degreasing compositions containing soy carbonate.

U.S. Pat. No. 7,135,446 is directed to glass cleaning compositions containing a solvent degreaser, such as soybean ester, in amounts ranging from 5 to 30%.

U.S. Patent Application Publication Nos. 2006/0052266 and 2007/0243101 include cleaning compositions containing up to 30% of methyl soyate as a solvent.

U.S. Patent Application Publication No. 2006/0094627 is directed to bi-solvent compositions suitable for cleaning precision components. One of the solvents in the bi-solvent system is soy-based, such as Soyclear 1500 (available form Ag Environmental Products).

U.S. Patent Application Publication No. 2006/0260064 covers fabric laundering compositions containing esters of fatty acids, including soy methyl esters.

The entire contents and disclosures of these references are incorporated herein by reference in their entirety.

Notwithstanding the above literature, the need remains for bio-based compositions suitable for a use as a cleaner, degreaser, and paint remover, among other uses.

A conventional technique for the preparation of epoxidized methyl soyate (EMS) includes epoxidation of methyl soyate by hydrogen peroxide (or an alkyl hydroperoxide) in the presence of formic or acetic acid. Use of various other catalyst systems has been disclosed. For example, CN 101284821 teaches using an ionic liquid catalyst (such as tributylmethylammonium tetrafluoroborate or 1-butyl-3-methylimidazolium tetrafluoroborate); CN 101235021 recommends using salts of heteropolyacids as catalysts; Catalysis Letters (2008), 122(1-2), 53-56 and Journal of Molecular Catalysis A: Chemical (2006), 250(1-2), 218-225 describe the effectiveness of titanium-containing mesoporous silica catalysts; CN 101139328 covers a magnetic catalyst; and CN 1966497 is directed to sulfuric acid and aluminum sulfate catalysts. Each of these references is incorporated herein by reference in its entirety.

SUMMARY OF THE INVENTION

The present invention is directed to bio-based cleaning compositions comprising an epoxidized fatty acid ester. The composition may optionally include a surfactant. If present, the surfactant preferably is present in an amount ranging from about 10 to about 20 wt. %, based on the total weight of the composition. In other embodiments, the composition may optionally include at least one co-solvent. The co-solvent may be present, for example, in an amount ranging from about 1 to about 25 wt. %, based on the total weight of the composition.

In certain embodiments, the epoxidized fatty acid ester is derived from a fatty acid selected from the group consisting of oleic acid, linoleic acid, linolenic acid and stearidonic acid. In some embodiments, the epoxidized fatty acid ester is derived from a fatty acid produced from a natural oil or a fat feedstock. Preferably, the feedstock is a renewable feedstock. For example, the feedstock may be selected from the group consisting of soybean oil, palm oil, peanut oil, olive oil, cotton seed oil, linseed oil, sesame oil, sunflower oil, canola oil, castor oil, rapeseed oil, jatropha oil, algae oil and tallow. In other embodiments, the epoxidized fatty acid ester is derived from an alcohol selected from the group consisting of linear alcohol, branched alcohol, substituted C1-C15 alkyl alcohols, glycols, alkenyl alcohol and aryl alcohol. The substituted alcohol may include acyl or carboxylate groups. In preferred embodiments, the epoxidized fatty acid ester is epoxidized methyl soyate (EMS). In one embodiment, the composition comprises the epoxidized methyl soyate in an amount from about 1 to about 100 wt. %, from about 20 to about 90 wt. %, or about 50 to about 80 wt. %, based on the total weight of the composition.

According to some embodiments, the epoxidized fatty acid is prepared by reacting one or more epoxidized triglycerides with one or more alcohols at an elevated temperature of, for example, from 40-120° C. The alcohols may include, for example, at least one of linear, branched, aliphatic, aromatic and functionalized C1-C12 mono- and polyhydric alcohol products. The triglycerides may include, for example, one or more plant oils. In some embodiments, the reaction is carried out in the presence of a catalyst. In certain embodiments of the invention, the epoxidized fatty acid, e.g., epoxidized methyl soyate, is prepared by reacting epoxidized soybean oil with methanol in the presence of sodium hydroxide at an elevated temperature, preferably 55° C.

In additional embodiments, the invention is directed to a method of cleaning, treating or degreasing a soiled substrate, said method comprising the step of applying a composition comprising an epoxidized fatty acid ester, preferably an epoxidized methyl soyate, to the soiled substrate. The soil may include materials, such as, for example, paint, ink or grease.

In still another embodiment, the invention is directed to a method of cleaning, treating or degreasing a soiled substrate, said method comprising the steps of: (a) applying a composition comprising an epoxidized fatty acid ester, e.g., epoxidized methyl soyate, to a soiled substrate; (b) waiting for a predetermined period of time; and (c) removing said composition and at least a portion of the soil from the substrate. The predetermined period of time may be in the range of from about 2 minutes to about 10 hours. In some embodiments, the removing step includes wiping the substrate with a cloth. In others, the removing step includes rinsing the substrate with a rinse solution. In certain embodiments, the method of cleaning, treating or degreasing a soiled substrate further comprises the step of scrubbing the substrate. In other embodiments, the method further includes repeating steps (a), (b) and (c).

In other embodiments, invention is directed to a cleaning kit comprising a bio-based composition comprising an epoxidized fatty acid ester, e.g., epoxidized methyl soyate, a tool for applying the bio-based composition, and an implement for removing the bio-based composition.

DETAILED DESCRIPTION OF THE INVENTION

The present invention relates to bio-based compositions comprising an epoxidized ester of one or more fatty acids, preferably an epoxidized methyl soyate, and methods of making and using such compositions.

Suitable fatty acids include those obtained from natural oils and fats such as soybean oil, palm oil, peanut oil, olive oil, cotton seed oil, linseed oil, sesame oil, sunflower oil, canola oil, castor oil, rapeseed oil, jatropha oil, algae oil and tallow, among others. Soybean oil is preferred. Suitable feedstocks include triglycerides of fatty acids, especially those of unsaturated fatty acids, such as oleic acid, linoleic acid, linolenic acid, stearidonic acid and others. Alcohols used for making the esters include linear, branched or substituted C1-C15 alkyl (methyl, ethyl, propyl, decyl, toll oil fatty acids etc.) alcohols, alkenyl (allyl) alcohol and aryl (cumyl) alcohols, to name a few. In some exemplary embodiments, the epoxidized fatty acid is prepared by reacting one or more epoxidized triglycerides with one or more alcohols at an elevated temperature, e.g., a temperature ranging from 40 to 120° C.

In a preferred embodiment, the bio-based composition includes epoxidized methyl soyate (EMS) as the epoxide of the fatty acid ester. EMS can be prepared, for example, via the epoxidation of fatty acid esters and epoxidation of fatty acids followed by esterification. According to some aspects of the invention, EMS can be prepared by alcoholysis (trans-esterification) of epoxidized triglycerides. In some exemplary embodiments, EMS may be prepared at elevated temperature by reacting epoxidized soybean oil with an excess of methanol, which may then be removed by vacuum distillation. In certain embodiments, this reaction is performed in the presence of sodium hydroxide at an elevated temperature, for example, a temperature of about 55° C.

The bio-based composition of the present invention can be blended or formulated with one or more co-solvents or additives. Suitable co-solvents include both conventional solvents (water, esters, alcohols and ketones, for example) and soy-based solvents (methyl soyate, for example). In various aspects of the invention, an epoxidized fatty acid ester composition comprising EMS is blended at least partially with both a conventional co-solvent and a soy-based co-solvent. The co-solvent can comprise a propellant for pressurized dispensing of the bio-based composition.

The amount of epoxidized esters of fatty acids in the bio-based composition may vary widely depending on the intended use for the composition. In some exemplary embodiments, the composition comprises the epoxidized ester of one or more fatty acids, preferably epoxidized methyl soyate, in an amount greater than 1 wt. %, e.g., greater than 20 wt. %, greater than 50 wt. % or greater than 80 wt. %. In terms of ranges, the composition preferably comprises the epoxidized ester of fatty acids, preferably epoxidized methyl soyate, in an amount from 1 to 100 wt. %, e.g., from 20 to 90 wt. %, or from 50 to 80 wt. %, based on the total weight of the composition.

The bio-based composition can also include one or more additives to enhance or modify one or more chemical or physical properties of the composition such as emulsification, wetting, stability, color, pH, viscosity, among others. Examples of additives include, but are not limited to, surfactants, corrosion inhibitors, fragrance, colorants, emulsifiers, thickener, viscosity control agents, antimicrobial and antifungal compounds, pH modifiers, among other compounds conventionally used in cleaners and solvents. In some exemplary embodiments, the composition comprises one or more additives in an amount ranging from 1 to 25 wt. %, based on the total weight of the composition.

The bio-based composition of the present invention can be employed for cleaning, treating or removing a wide range of materials from a substrate. For example, the bio-based composition can be employed as a general purpose cleaner, parts cleaner, degreaser, tar and asphalt remover, paint remover, ink remover, sewage treatment material, hand cleaner, carpet stain remover, and as an additive to an aerosol compound, heat transfer medium, among other uses. In addition, any suitable substrate may be cleaned or treated using the compositions of the present invention including, but not limited to, metal, glass, wood, fabric, plastics, composites and the like.

To clean, treat or remove a material from a substrate, the bio-based composition is applied to the substrate or portions thereof in an amount and under conditions effective to clean, treat or remove the material from the substrate. In some embodiments, the composition is sprayed onto the substrate. The inventive composition can also be dispensed in a stream, in an aerosol or in a gel-like form, among others. The amount of the composition applied preferably is proportional to the surface area being cleaned or treated and the degree to which the substrate is soiled.

The methods of the present invention are generally comprised of the steps of contacting a soiled substrate with the bio-based composition for a time period sufficient to effectively clean, treat or remove material from the substrate, and then removing the composition from the substrate. In certain embodiments, the predetermined period of time may be in the range of from about 2 minutes to about 10 hours. After the substrate is sufficiently cleaned or treated, the bio-based composition is wiped off, rinsed off or otherwise removed from the substrate. The removal rate may be enhanced by agitation and/or exposure to heated rising solution.

Some embodiments of the invention provide a method of cleaning, treating or degreasing a soiled substrate, said method comprising the steps of: (a) applying a composition comprising an epoxidized fatty acid ester, e.g., epoxidized methyl soyate, to a soiled substrate; (b) waiting for a predetermined period of time; and (c) removing said composition and at least a portion of the soil from the substrate. In certain embodiments, the method of cleaning, treating or degreasing a soiled substrate further comprises the step of scrubbing or brushing the substrate. In other embodiments, the method further includes repeating steps (a), (b) and (c).

According to one embodiment of the invention, a method useful for removing grease from a substrate includes applying a degreasing composition to a grease on the substrate in an amount and under conditions effective to remove at least a portion of the grease from the substrate, and then removing the degreasing composition from the substrate.

According to another embodiment of the invention, the invention is to a method for removing paint or ink from a substrate comprising applying a paint or ink removing composition comprising an epoxidized ester of one or more fatty acids, preferably an epoxidized methyl soyate, to the paint or ink on the substrate in an amount and under conditions effective to remove at least a portion of the paint or ink from the substrate, and then removing the paint or ink removing composition from the substrate.

In some embodiments of the invention, the bio-based composition is supplied or used as a concentrate and is capable of being admixed with one or more co-solvents prior to use. In a preferred embodiment, the bio-based composition is admixed with water and emulsified immediately prior to use.

The invention described herein also encompasses cleaning, treatment or removal kits including the bio-based composition. The kits may further include items such as, for example, a drop sheet or cloth, tools for applying the bio-based composition such as a spatula or hand actuated spray bottle, and implements for removing the bio-based composition such as a cloth, squeegee or hand actuated spray bottle containing a rinse solution. In some embodiments, the bio-based composition can be stored in pre-measured proportions within individual sealed containers, and the individual containers may be stored in a larger container. The individual containers and larger container may be of any design.

The kit may further include an instruction sheet that outlines the procedural steps of the methods, and will follow substantially the same procedures as described herein or are known to those of ordinary skill. The instruction information may be in a computer readable media containing machine-readable instructions that, when executed using a computer, cause the display of a real or virtual procedures for cleaning or treating the substrate. In certain embodiments, the material safety data sheets (MSDS) for the some or all of the components of the kit are also included.

EXAMPLES

In order that the invention disclosed herein may be more efficiently understood, the following examples are provided. These examples are for illustrative purposes only and are not to be construed as limiting the invention in any manner.

I. Preparation of Epoxidized Methyl Soyate

A sample of epoxidized methyl soyate (EMS) was prepared via epoxidation of methyl soyate. 700 g of epoxidized soybean oil (available from Chemtura Corporation as Drapex 6.8) was placed into a 2 L round-bottom flask equipped with an agitator and thermometer. Next, 140 g of 2.5% sodium hydroxide in methanol (Reagent grade from Aldrich), containing pre-dissolved 3.5 g solid sodium hydroxide and 136.5 g methanol, were added to the flask. The temperature of the reaction mixture was raised to 55° C., and the mixture was agitated and maintained at 55° C. for 2.5 hours. The reaction was then stopped and the contents of the flask were allowed to settle for 30 minutes in a separatory funnel. The lower crude glycerin layer (73.4 g) was decanted and the product layer was transferred into a drying flask and dried using a water aspirator under approximately 50 mm Hg vacuum at 96° C. maximum. The dried warm product was filtered through # 412 Whatman paper with filter aid and then refiltered at room temperature though a Whatman # 2 filter with filter aid yielding 662 g of a nearly clear yellow liquid product.

II. Evaluation of Epoxidized Methyl Soyate

The sample of EMS was characterized with regard to cleaning performance, emulsification' properties and paint removal performance following the guidelines provided in OmniTech International, LLC, USB Project No. 7429 "Physical and Cleaning Performance Properties of Methyl Soyate"—Report, November, 1997, p. 3-8, which is incorporated by reference in its entirety to the extent such reference does not conflict with the teachings of this specification.

A. Evaluation of Cleaning Performance

The efficacy of EMS in removing oil and grease from a metal substrate was examined and compared to a series of control solvents. The soils utilized in the examination included Castor Oil #1 (Vertellus Specialties, Inc.), Slugger Cutting Fluid (Jancy International, Inc.) and Cutting Oil Quakercut 042 ESC (Industrial Fluid Systems). The control solvents utilized in the characterization included DBE-9 (a dibasic ester from DuPont), methyl soyate, methylene chloride (reagent grade from Aldrich), Odorless Mineral Spirits (OMS) and methyl ethyl ketone (MEK, reagent grade from J. T. Baker).

Before application of the soils, the metal substrates or coupons were prepared as follows: steel, AISI C-1010, 1 inch×2 inch×1/16 inch polished coupons were degreased by immersing the coupons in a beaker containing trichloroethylene (reagent grade from Aldrich). The coupons were then removed and the excess solvent was allowed to evaporate. The coupons were placed in an oven at 65° C. for one (1) hour, and then cooled to ambient temperature in a desiccator. The weight of each degreased coupon was determined on a four decimal balance and recorded. Each degreased coupon was then dipped into a soil, placed into an alligator-clip to allow the excess soil to drip off and re-weighed to determine the amount of soil applied to the metal surface.

The soiled coupons were immersed into EMS and each of the control solvents for one (1) minute at ambient temperature, placed into an alligator-clip to allow the excess solvent to drip off and then placed into the oven set at 65° C. for three (3) hours. The coupons were next cooled to ambient temperature in a desiccator. The weight of each coupon was determined on a four decimal balance and recorded and the percent of soil removal was calculated for each soil/solvent combination. The degreasing/cleaning properties of EMS and the control solvents are provided in Table 1.

TABLE 1

| Soil | Solvent | % Removal |
|---|---|---|
| Slugger Cutting Fluid | DBE-9/control | 53 |
| | Methyl Soyate/control | 17 |
| | EMS | 16 |
| | Methylene Chloride/control | 92 |
| | OMS/control | 81 |
| Castor Oil #1 | DBE-9/control | 91 |
| | Methyl Soyate/control | 53 |
| | EMS | 81 |
| | Methylene Chloride/control | 91 |
| | OMS/control | 78 |
| | MEK/control | 95 |
| Cutting Oil Quakercut 042 ESC | DBE-9/control | 79 |
| | Methyl Soyate/control | 21 |
| | EMS | 13 |
| | Methylene Chloride/control | 79 |
| | OMS/control | 86 |
| | MEK/control | 90 |

The results indicate that EMS surprisingly and unexpectedly was more efficient than methyl soyate in removing Castor Oil #1. EMS and methyl soyate were similar in terms of their ability to remove Slugger Cutting Fluid and Cutting Oil Quakercut 042 ESC.

B. Evaluation of Emulsification Properties

The ability of EMS to separate from water as compared to other control solvents was examined and characterized. This information can be useful as it relates to solubility in and affinity to water. This evaluation also facilitates characterization of the relative polarity of various solvents. The control solvents utilized in the characterization include DBE-9, methyl soyate, methylene chloride, OMS and MEK.

30 ml of EMS and each of the control solvents were individually added to 70 ml of de-ionized water in a graduated cylinder with a ground glass top. The cylinder was agitated by hand to ensure mixing (10 strokes) and placed onto the lab bench to allow for separation. The water-emulsification properties of EMS and the control solvents are provided in Table 2.

TABLE 2

| Solvent | Phase separation time, min. | Comments/Separated Volume, ml |
|---|---|---|
| MEK/control | 0.5 | Fully miscible/ No separation |
| DBE-9/control | 5.0 | 20 |
| | 7.0 | 23 |
| | 10.0 | 24 |
| | 15.0 | 24 |
| EMS | 5.0 | 62 |
| | 7.0 | 64 |
| | 12.0 | 65 |
| | 15.0 | 66 |
| Methyl Soyate/control | 3.0 | Fully separated |
| OMS/control | 0.5 | Fully separated |
| Methylene Chloride/control | 0.5 | Fully separated |

The results indicate that the solubility of EMS in water is surprisingly similar to that of DBM-9, an ester-type solvent, as opposed to methyl soyate. However, DBE-9 is heavier, while EMS is lighter than water. It appears that EMS is partially soluble in water, and therefore, its solubility is intermediate between fully water miscible solvents, such as MEK, and completely insoluble solvents, such as methyl soyate, OMS and methylene chloride.

C. Evaluation of Paint Removal Properties

The efficacy of EMS to remove paint from an aluminum surface was compared to that of several control solvents. Three types of paint were included in the study: Glidden White Interior Semi-gloss latex ("White Latex"), Dupli-Color Auto Spray Clear Top Coat ("Clear Top Coat") and Dupli-Color AutoSpray White Primer ("White Primer"). The control solvents tested included DBE-9, methyl soyate, MEK and OMS.

Aluminum unpolished 3"×3" panels were weighted, laid flat on the lab bench and painted with a paint. The weight of the painted panels was recorded and then 1.00 ml of a solvent was placed on the center of each panel with a pipette. The solvent remained in contact with the painted panels for one (1) hour. After that, the panels were subjected to a 30 second scrub using a 1 inch×1 inch abrasive scrubbing pad. The weight of each panel was recorded and the percent of paint removal was calculated for each paint/solvent combination. The results are provided in Table 3.

TABLE 3

| Paint | Solvents | % Removal |
|---|---|---|
| White Latex | DBE-9/control | 14 |
| | Methyl soyate/control | 100 |
| | EMS | 87 |
| | MEK/control | 100 |
| | OMS/control | 2 |
| Clear Top Coat | DBE-9/control | 63 |
| | Methyl soyate/control | 79 |
| | EMS | 97 |
| | MEK/control | 24 |
| | OMS/control | 96 |
| White Primer | DBE-9/control | 40 |
| | Methyl soyate/control | 73 |
| | EMS | 56 |
| | MEK/control | 1 |
| | OMS/control | 1 |

The results show that EMS surprisingly and unexpectedly was more effective than methyl soyate in removing Clear Top Coat paint.

Although the present invention has been described in considerable detail with reference to certain preferred aspects, other versions are possible. Various modifications of the invention, in addition to those described herein, will be apparent to those skilled in the art. As such, the spirit and scope of the appended claims should not be limited to the description and the preferred versions contained within this specification.

What is claimed is:

1. A bio-based cleaning composition, comprising:

an epoxidized fatty acid ester; and from about 10 to about 20 wt. %, based on the total weight of the composition, of a surfactant.

2. The composition of claim 1, wherein the epoxidized fatty acid ester is derived from fatty acid selected from the group consisting of oleic acid, linoleic acid, linolenic acid and stearidonic acid.

3. The composition of claim 1, wherein the epoxidized fatty acid ester is derived from fatty acid produced from a natural oil or fat feedstock.

4. The composition of claim 1, wherein the epoxidized fatty acid ester is derived from fatty acid produced from a renewable feedstock selected from the group consisting of soybean oil, palm oil, peanut oil, olive oil, cotton seed oil, linseed oil, sesame oil, sunflower oil, canola oil, castor oil, rapeseed oil, jatropha oil, algae oil and tallow.

5. The composition of claim 1, wherein the epoxidized fatty acid ester is derived from alcohol selected from the group consisting of linear alcohol, branched alcohol, substituted C1-C15 alkyl alcohols, glycols, alkenyl alcohol and aryl alcohol.

6. The composition of claim 1, wherein the epoxidized fatty acid ester is derived from substituted alcohol comprising an acyl group or a carboxylate group.

7. The composition of claim 1, wherein the epoxidized fatty acid ester comprises epoxidized methyl soyate.

8. The composition of claim 7, wherein the composition comprises epoxidized methyl soyate in an amount from about 20 to about 90 wt. %, based on the total weight of the composition.

9. The composition of claim 7, wherein the composition comprises epoxidized methyl soyate in an amount from about 50 to about 80 wt. %, based on the total weight of the composition.

10. The composition of claim 1, wherein the epoxidized fatty acid ester is prepared by reacting epoxidized triglycerides with alcohols at an elevated temperature of 40-120° C.

11. The composition of claim 10, wherein the alcohols include at least one of linear, branched, aliphatic, aromatic and functionalized C1-C12 mono- and polyhydric alcohol products.

12. The composition of claim 10, wherein the triglycerides include plant oils.

13. The composition of claim 10, wherein the reaction is carried out in the presence of a catalyst.

14. The composition of claim 1, wherein the epoxidized fatty acid is prepared by reacting epoxidized soybean oil with methanol in the presence of sodium hydroxide at an elevated temperature.

15. The composition of claim 1, further comprising at least one co-solvent.

16. The composition of claim 15, wherein the composition comprises the co-solvent in an amount from about 1 to about 25 wt. %, based on the total weight of the composition.

17. A cleaning kit, comprising:

a bio-based composition comprising an epoxidized fatty acid ester;

a tool for applying the bio-based composition; and an implement for removing the bio-based composition.

18. The cleaning kit of claim 17, wherein the tool is a spatula or a hand-actuated spray bottle.

19. The cleaning kit of claim 17, wherein the implement is a cloth, squeegee, or a hand-actuated spray bottle containing a rinse solution.

20. The cleaning kit of claim 17, further comprising a cloth or a drop sheet.

21. The composition of claim 1, further comprising at least one additive selected from the group consisting of corrosion inhibitors, fragrance, colorants, emulsifiers, thickeners, viscosity control agents, antimicrobial and antifungal compounds, and pH modifiers.

* * * * *